United States Patent [19]

Rosen

[11] Patent Number: 4,776,472

[45] Date of Patent: Oct. 11, 1988

[54] BAKERY DISPLAY SHELVES

[75] Inventor: Howard Rosen, Brooklyn, N.Y.

[73] Assignee: Brand Manufacturing Corp., Brooklyn, N.Y.

[21] Appl. No.: 107,380

[22] Filed: Oct. 9, 1987

[51] Int. Cl.[4] ..... A47F 5/00

[52] U.S. Cl. ..... 211/187; 108/102; 108/137; 211/150; 211/175

[58] Field of Search ..... 211/134, 187, 151, 150, 211/153, 175, 193; 108/102, 105, 137, 143

[56] References Cited

U.S. PATENT DOCUMENTS

| | | | |
|---|---|---|---|
| 4,063,518 | 12/1977 | Bustos | 108/137 X |
| 4,589,349 | 5/1986 | Gebhardt et al. | 108/102 |
| 4,602,570 | 7/1986 | Lee | 108/102 |
| 4,620,489 | 11/1986 | Albano | 108/143 X |
| 4,646,656 | 3/1987 | Marschak | 211/153 X |
| 4,646,658 | 3/1987 | Lee | 108/137 X |
| 4,658,969 | 4/1987 | Mastrodicasa | 211/153 X |

*Primary Examiner*—Robert W. Gibson, Jr.
*Attorney, Agent, or Firm*—Bauer & Schaffer

[57] ABSTRACT

A plurality of horizontal shelves extend outwardly from a vertical supporting wall. Each of the shelves is formed on an arm structure having a pair of horizontally spaced arms connected by a cross member and a rack slidably resting on the arms across the width of the shelf lengthwise from arm to arm. The rack has a front section and a back section articulatingly interconnected, and slidable on the arms from a forward position wherein the front and back sections of the rack rest upon the arm and a rearward position wherein the front section only of the rack rests upon the arm and the back section of the rack extends perpendicularly therefrom and abuts against the wall.

10 Claims, 2 Drawing Sheets

22
24
48
23
12
21
A
55
22
25
48
48
B
50
40
25
C
48
12
40
48
D
48
10
41
48
50
35
20
34
35
31
X
34
33
32
33
35

BAKERY DISPLAY SHELVES

BACKGROUND OF THE INVENTION

The present invention relates to a storage and display unit and in particular to a shelf unit for use in retail sales displays.

The cost of conducting retail sales, in particular for small food shops, clothing shops and the like is influenced greatly by the cost of the real estate and/or rental property. Retail establishments, therefore, attempt to occupy the smallest space available and they try to utilize as much of the space as possible for point of sale, storage and display devices. The display devices are, therefore, set upon with minimum passage space between them and are built so as to be freestanding and, therefore, somewhat movable. Further, these units are made with relatively shallow shelf depth so that the maximum number of display units can be employed within any given area.

In general, for normal times, particular seasons of the year, such units are more than acceptable. However, during certain other times, i.e. holiday seasons, the number and size of the shelves or display units are insufficient for the amount of merchandise to be sold. It is, therefore, necessary to provide at least a temporary additional space for the storage display. This means in general the purchase and "cold" storage of a number of shelf units which are normally not used.

It is the principal object of the present invention to provide a storage and display unit which is adjustable from normal use configuration to a configuration for use in extraordinary periods of time so as to provide additional space when needed and not be any larger overall than the normal unit.

It is a particular object of the present invention to provide a storage and display unit which is provided with shelves which may be easily enlarged or reduced to provide either shallow or wider depth as needed.

It is yet another object of the present invention to provide a storage and display device in which adjustment can be made without dismantling or replacing of the unit, or the shelves either in whole or in part.

It is yet another object of the present invention to provide a storage and display device which is attractive in appearance, simple and economical to construct and install and simple to use.

The foregoing objects, together with other objects and advantages, will become apparent from the following disclosure of the present invention.

SUMMARY OF THE INVENTION

According to the present invention, a storage and display unit is provided having a plurality of horizontal shelves extending outwardly from a vertical supporting wall. Each of the shelves comprise an arm structure having a pair of horizontally spaced arms connected by a cross member and a rack slidably resting on the arms across the width of the shelf lengthwise from arm to arm. The rack has a front section and a back section articulatingly interconnected. The rack is slidable on the arms from a forward position wherein the front and back sections of the rack rest upon the arm and a rearward position wherein the front section only of the rack rests upon the arm and the back section of the rack extends and abuts against the wall. In this manner, the depth of the shelf can be adjustable from one which includes both the front and back sections to one which includes only the front section of the rack.

Preferably, the front section of the rack is substantially equal in depth to that of the arms and the back section is about half that distance. Cooperating means are provided on the front and back sections of the rack which maintain the back section perpendicular to the forward section when the rack is placed in its rearward position. This prevents the back section from falling over onto the front section when not needed. The arms preferably include detents engaging the rack which inhibit the sliding of the rack from the first to the second position including a vertical tab which engages the rack and which maintains the rack in a fixed position once placed in the extended forward position.

Preferably, the rack is formed of a wire mesh frame which permits circulation of air and simple manipulation while maintaining sufficient frigidity to support the product thereon.

Preferably, the arm structure for the shelf is adjustable along the height of the wall which is, itself, mounted on a freestanding base which, itself, may be adjustable in size.

Full details of the present invention are set forth in the following description and are illustrated in the accompanying drawings.

DESCRIPTION OF THE INVENTION

Figure 1:
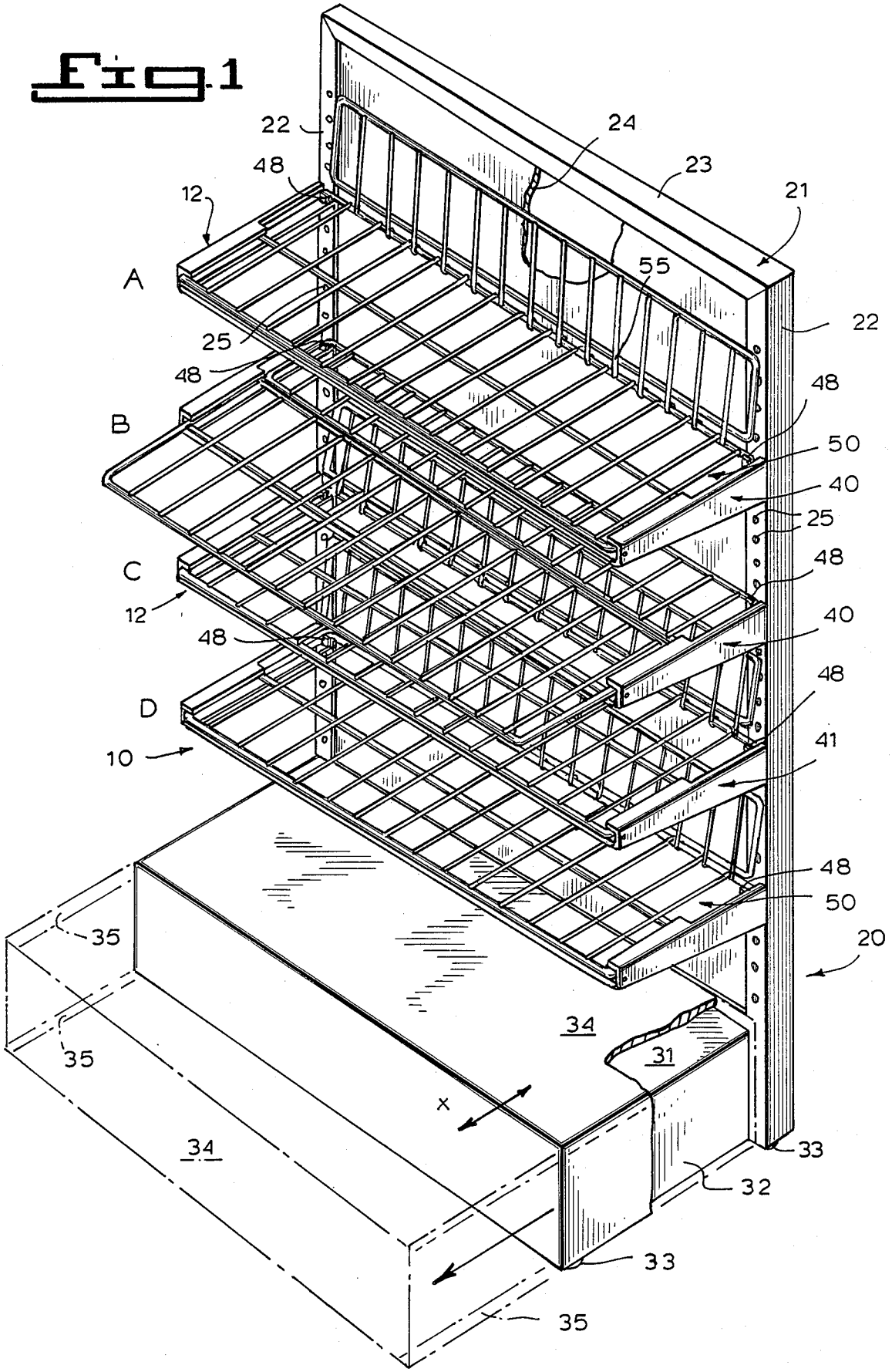
FIG. 1 is a perspective view of the storage and display unit embodying the present invention and which is partially broken away to show the details of construction.

As seen in FIG. 1, the storage and display unit generally depicted by the numeral 10 has a plurality of shelves 12 each adapted to support product. The shelves 12 extend forwardly from an upright rear wall 20 secured on a rectilinear box-like base 30 so as to be entirely freestanding, self-supporting and extremely stable. Each shelf 12 comprises an arm structure 40 on which is supported a wire mesh rack 50. The upright supporting wall 20 is formed of a rectangular frame section 21 consisting of a pair of tubular posts 22 and a cross member 23 enclosing a backing sheet 24. The vertical posts 22 are formed with a plurality of holes 25 uniformly spaced along their length in which the arm structure 40 can be supported at a given selective height. Preferably, the backing sheet 24 is plastic or formed of composite material to lighten the weight of the unit while the vertical posts 22 and cross member 23 are made of heavy gauge metal, such as steel or aluminum, to provide ample support for the shelves 12.

The frame section 21 is welded to or formed integrally with the base 30 which is formed as a plate or sheet-like shelf 31, having depending side skirt 32, preferably made of metal to provide the necessary ballest. The base 30 may be filled with metal or other weight should it be necessary to increase its mass. As seen in FIG. 1, the base shelf 31 is provided with a plurality of adjustable feet such as screw pads 33, which allow the base to be leveled with respect to the floor on which it is placed. The base 30 is also provided with a cover 34 which slidably fits over the base shelf 31 so as to be movable from an inward position, shown in full lines in FIG. 1, to an extended position shown in dotted lines. Preferably, the cover 34 is provided with rolled or tubular corner fittings 35 and dimensioned so that the tubular fittings slide over the corners, and/or edges of the base shelf 31 very easily and yet provide for sufficient rigidity and integrity of shape for the cover. In this manner, the size of the base may be readily adjustable, with minimum effort.

Figure 2:
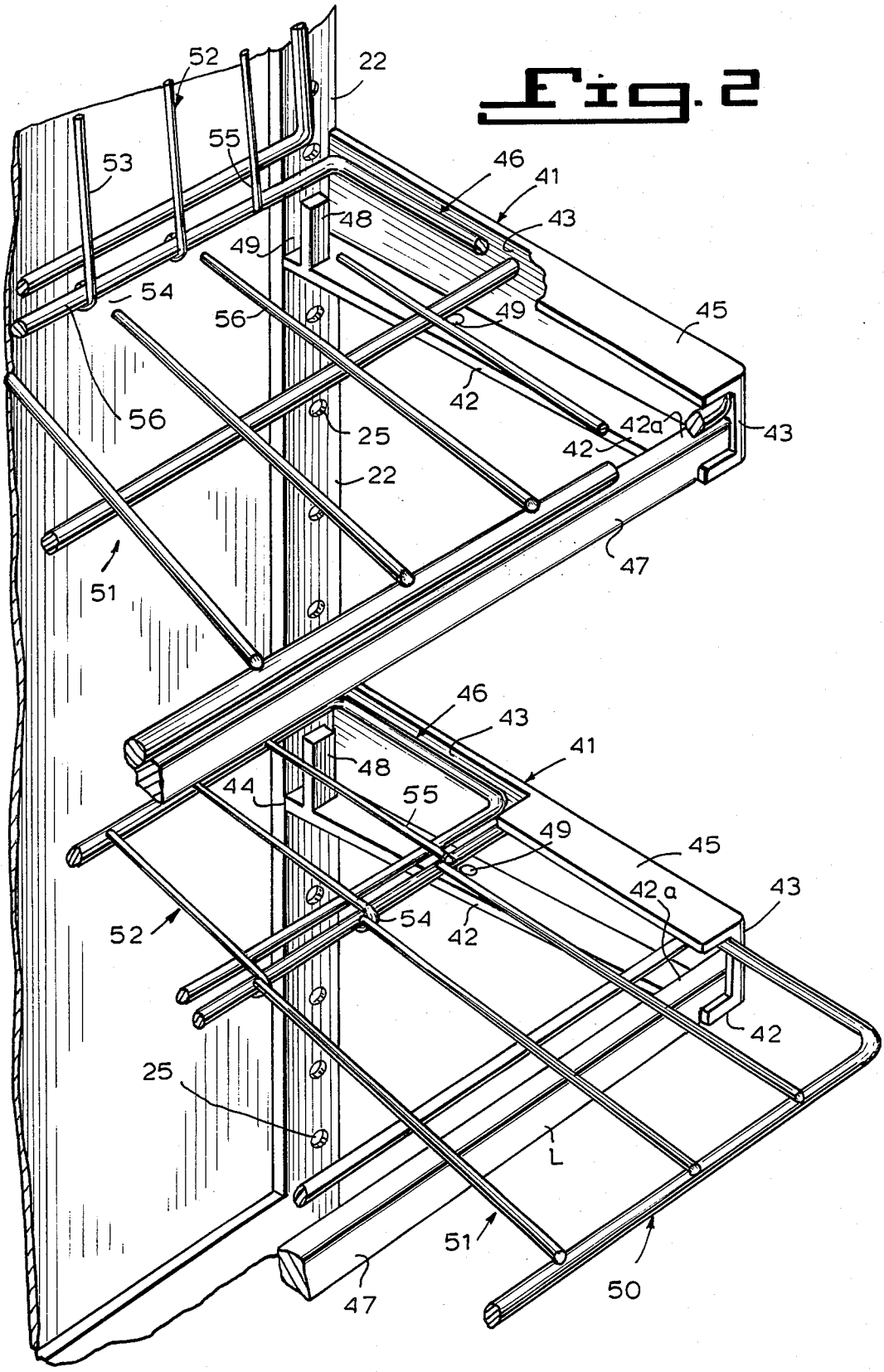
FIG. 2 is an enlarged perspective view of the storage and display unit showing the details of the shelf construction.

As seen in FIG. 1, each of the shelf supporting arm structures 40 are formed of a pair of arms 41 arranged in mirror image to each other. In FIG. 2, only one arm 41, namely the right side as viewed in the drawings, in each arm structure 40 is shown, it being understood that the opposing arm is identical. The arm 41 has an angle-shaped cross section providing a lower, inwardly directed rail 42 and a vertically extending side rail 43. The side rail 43 is provided with locking means, such as a screw bolt, at its rear edge adapted to fit into selected mounting holes 25 formed in the vertical posts 22 of the back wall 20. Preferably, the screw bolts are held by nuts attached hereto on the rear side of the post 22. It should, however, be apparent that the locking means by which the arm structure is held to the post can be modified so as to use a more easily removable hook-shaped end, fitting into a suitably dimensioned slot rather than screw holes 25 formed in the posts, similar to that used in adjustable bookshelves. The lower rail 42 terminates in a square edge 44 which is adapted to abut against the face of the associated post 22 thereby forming a stop capable of holding the arm 41 in its extended position even with the weight of a product thereon.

The arm 41 is also provided with an inwardly directed ledge 45 from the upper edge of the side rail 43 rearwardly toward the post 22 approximately half the distance thereto. This leaves an open upper space 46 from the mid-point of the side rail to the post 22.

Each of the arms 41 in the arm structure 40 is joined together by a cross bar 47 which is welded or otherwise integrally secured at its ends to the respective arm 41.

Just short of the rear end of the lower rail 42, there is integrally attached, as by welding, a small upstanding tab 48 which rises from the surface of the lower rail 42 leaving a space 49 between it and the post 22, sufficient to receive a section of the lengthwise rear wires of the rack 50 so as to hold the rack firmly in place, as will be explained further hereinafter. Lastly, the lower rail 42 is provided substantially midway along its length with a raised dimple 49 adapted to engage and raise the central portion of the rack 50 upwardly into contact with the ledge 45 as explained also hereinafter.

The cross bar 47 joining the paired arms 45, is square in cross section and is arranged at each end, in the respective arm 41 so that a shallow shoulder 42*a* is formed above the level of the lower rail 42 over which the rack 50 must pass and be wedge upwardly against the overextending ledge 45.

The wire mesh rack 50 is formed of a rectangular wire frame section 51. The mesh and form of the wire frame section 51 is not critical except that it should have a dimension conforming to the overall dimension created by the arm structure 40, i.e., the distance between its side edges, conform to the length between the arms 41 while the distance between the longitudinally extending front and rear edges of the frame 51 conform to the depth of the arm structure 41. In addition, a back frame section 52, of the same length but approximately half the depth of the front frame section 51, is provided. The back frame section 52 is articulatingly connected to the front frame section 51 by elongating its transverse rods 53 and forming eye loops 54 which engage over the rear longitudinal edge of the frames section 51. This permits the back frame section 52 to move freely with respect to the front frame section 51. Some, for example each fourth or fifth, of the transverse rods 53 of the back frame section are not provided with eye loops but extend straight and are cut short to form extending stubs 55, which stubs act to engage and abut against the transverse rod members 56 of the front frame section 51, thereby limiting the free pivotal movement of the back frame section 52 with respect to the front frame section 51 such that the back frame section cannot move or fall forwardly over the front frame section and will thus assume a perpendicular relationship thereto when pivoted in the forward direction. However, when pivoted in the rearward direction at the back frame section 52 will tend to fall rearwardly flat and assume a coplanar position with respect to the front frame section 51.

Returning to FIG. 1, the storage and display unit is assembled so that the vertical wall 20 is permanently adhered to the base 30, and a plurality of arm structures 40 are arranged in spaced vertical relationship to each other by selective positioning in holes 25. The wire mesh racks 50 are inserted into the respective arm structures by sliding the same in flat condition over the lower rail 42 as seen at the level B. Although the frame sections of the rack 50 wedges with the cross bar 47 and with the dimple 49 on the lower rail 42 can be made to pass thereover to eventually assume the very flat position shown on level B. In this position, the back frame section 52 of the rack 50 can be lifted since the space 46 allows for its movement upward and pivoting about the rear edge of the front frame section 51 into a more or less vertical position as seen on level A. In this latter position as the truncated fingers 55 engage the associated transverse rods 56 on the horizontally disposed front frame section 51 of the rack. In this condition, the entire rack 50 can be pushed rearwardly so that the back frame section 52 stands vertically against the back wall 20. The back frame section 52 will not tilt forward since the depending tabs 55 engage the corresponding transverse rods 56 on the front frame section 51 and the back frame section 52 is maintained in a vertical position, as seen in levels A, C and D. In this situation the shelves produced have a small depth equal of course to the depth only of the front frame section.

On the other hand, when it is desired to enlarge the depth of the shelves (either one or more), the appropriate rack 50 is pulled forwardly as seen in the lower portion of the FIG. 2. In doing this the rear frame section 52 falls backwardly into a planar configuration with the front section until it falls onto the lower rail 42 of the arm 441. As it falls the rear wire of the frame section 52 falls into the space between the post 22 and the upward tab 48. The rack 50 consequently hooks onto each tab 48 in the arm structure 41 and cannot be pulled further in the forward direction and is held firmly in place.

Although the front half of the front frame section 51 extends cantilevered over and beyond the cross 47 it is held firmly in place by cooperation of the upper ledge 45 of each arm and the rising shoulder 42*a* at the front of the arm. The dimple 49 also engaged the rack 50 as at the longitudinal wires and assists in holding the rack 50 in place. Thus, in the extended or enlarged position the shelf has the size of both the front and rear rack sections.

Similarly, when the base 30 is intended to be enlarged, the cover 34 can be simply moved forward in the direction of the arrow X as seen in FIG. 1, thereby enlarging the base. Thus, any one of the shelves and the base can be adjusted.

Reversal of the above procedure enables the shelves to be easily reduced to the shallow depth position. Lifting of the back frame section 52 is permitted by the existence of the open part 46 of arm 41.

Various modifications and changes have been illustrated and suggested and others will be obvious to those skilled in this art. Accordingly, it is intended that the present disclosure be taken as illustrative and not as limiting to the scope of the invention.

What is claimed is:

1. A storage and display unit having a plurality of horizontal shelves extending outwardly from a vertical wall, at least one shelf comprising a pair of horizontally spaced arms and a rack extending across said arm lengthwise of said shelf, said rack having a front section and a back section articulatingly connected together, said rack resting on and being slidable on the upper surface of said arms from a forward position wherein said front and back sections of said rack rest upon said arms in a common plane and a rearward position wherein the front section of said rack rests upon said arms and the back section of said rack extends perpendicularly to said front section and abuts against said vertical wall, whereby the depth of said shelf may be adjusted on movement of said rack.

2. The storage and display unit according to claim 1 wherein said front section is substantially equal in depth to the length of said arms and said back section is approximately half thereof.

3. The storage and display unit according to claim 1 wherein said front and back sections having cooperating means for maintaining said back section perpendicular to said front section when in the rearward position.

4. A storage and display unit having a plurality of horizontal shelves extending outwardly from a vertical wall, at least one shelf comprising a pair of horizontally spaced arms and a rack extending across said arm lengthwise of said shelf, said rack having a front section and a back section articulatingly connected together, said rack being slidable on said arms from a forward position wherein said front and back sections of said rack rest upon said arms and a rearward position wherein the front section of said rack rests upon said arms and the back section of said rack extends and abuts against said vertical wall, whereby the depth of said shelf may be adjusted on movement of said rack, said front and back sections include means for maintaining said rear section perpendicular to said front section in the rearward position, cooperating means includes a finger extending from said back section into contact with the front section.

5. The storage and display unit according to claim 4 wherein the upper surface of at least one arm in each pair of arms includes embossment means engaging said rack to restrict sliding of said rack from said forward position into said rearward position.

6. The storage and display unit according to claim 4 comprises a vertical tab extending upwardly from at least one arm in each pair of arms, said vertical tab being located adjacent said vertical wall, and spaced therefrom the rear end of said rack engages behind said tab when in the forward position, to selectively prevent said rack from sliding off said pair of arms.

7. The storage and display unit according to claim 6 wherein said rack is formed of a wire frame.

8. The storage and display unit according to claim 1 wherein each said arm is adjustable along the height of said vertical wall.

9. The storage and display unit according to claim 1 wherein said vertical wall is freestanding and is mounted on a supporting base.

10. The storage and display unit according to claim 9 wherein said base comprises a rectangular body having a length and a depth at least equal to that of said shelf and an upper surface, a footing for stabilizing said base relative to the ground, and a cover member slidable over said base between a rear position co-extensive with said base and a forward position extending forwardly of said base to enlarge the upper surface of said base.

* * * * *